US006065998A

United States Patent [19]

Peloza

[11] Patent Number: 6,065,998

[45] Date of Patent: May 23, 2000

[54] ELECTRICAL CONNECTOR FOR COAXIAL CABLE

[75] Inventor: Kirk B. Peloza, Naperville, Ill.

[73] Assignee: Molex Incorporated, Lisle, Ill.

[21] Appl. No.: 09/222,234

[22] Filed: Dec. 29, 1998

[51] Int. Cl.[7] ..... H01R 9/05

[52] U.S. Cl. ..... 439/578; 439/394; 439/108

[58] Field of Search ..... 439/578, 581, 439/582, 108, 98, 99, 341, 610, 459, 467, 394

[56] References Cited

U.S. PATENT DOCUMENTS

| | | | |
|---|---|---|---|
| 4,708,414 | 11/1987 | Lam | 439/394 |
| 4,946,392 | 8/1990 | Kobler et al. | 439/63 |
| 5,083,934 | 1/1992 | Kawaguchi | 439/394 |
| 5,154,632 | 10/1992 | Ijiri | 439/394 |
| 5,267,868 | 12/1993 | Wolff, Jr. | 439/95 |
| 5,304,069 | 4/1994 | Brunker et al. | 439/108 |
| 5,482,475 | 1/1996 | Kawaguchi | 439/394 |

FOREIGN PATENT DOCUMENTS 06251832 9/1994 Japan .

*Primary Examiner*—Paula Bradley
*Assistant Examiner*—Tho D. Ta
*Attorney, Agent, or Firm*—Stephen Z. Weiss

[57] ABSTRACT

An electrical connector is provided for terminating a coaxial cable having at least an inner conductor and an outer conductive shield. The connect-or includes a coaxial cable carrier for receiving the coaxial cable and including a ground terminal, the carrier being in engagement with the conductive shield of the cable. A terminal module includes an insulator mounting a signal terminal. The module is assembled on the carrier to form a subassembly with the signal terminal generally parallel to the ground terminal. A conductive shielding shell receives the subassembly with the conductive shell being in engagement with the coaxial cable carrier. A cover is mounted on the shell for holding the conductor of the cable in engagement with the signal terminal of the terminal module.

25 Claims, 4 Drawing Sheets

ELECTRICAL CONNECTOR FOR COAXIAL CABLE

FIELD OF THE INVENTION

This invention generally relates to the art of electrical connectors and, particularly, to a connector for terminating a coaxial cable.

BACKGROUND OF THE INVENTION

Electrical connectors are known for terminating a coaxial cable so that the cable can be connected to other connecting devices, such as the terminals of a complementary mating connector, the circuit traces on a printed circuit board and the like. As is known, a typical coaxial cable includes a center conductive core or conductor surrounded by an insulating or dielectric sheath. A conductive shield surrounds the insulating sheath and typically is a metal braid. The shielding braid is surrounded by an outer dielectric tubular cover of the cable.

Various problems continue to be encountered when terminating coaxial cables in a connector, and many of those problems center around the extremely small size of the cables. For instance, the conductive core or conductor of a radio frequency coaxial cable may be very small in diameter. Not only must the conductor of the cable be connected to a signal terminal of the connector, but the shielding braid of the cable must be connected or otherwise engaged with a shell or ground terminal of the connector. Such coaxial cable connectors are quite complex to manufacture and are especially difficult to assemble and terminate to the cable, particularly by hand termination. It also is difficult to maintain proper positioning and spacing of the terminals within the connector, itself to ensure a consistent impedance throughout the connector. The present invention is directed to solving these various problems by providing a very efficient coaxial cable connector which is very easy to assemble and terminate.

SUMMARY OF THE INVENTION

An object, therefore, of the invention is to provide a new and improved electrical connector for terminating a coaxial cable. As stated above, the cable has at least an inner conductor and an outer conductive shield.

In the exemplary embodiment of the invention, the connector includes a coaxial cable carrier for holding the coaxial cable. The carrier includes a forwardly projecting ground terminal, and the carrier is engaged with the conductive shield of the cable. A terminal module, including an insulator mounting a forwardly projecting signal terminal, is mountable on the carrier to form a subassembly, with the signal terminal generally parallel to the ground terminal. A conductive shielding shell receives the subassembly, with the conductive shell being in engagement with the conductive carrier. A cover is mounted on the shell for holding the conductor of the cable in engagement with the signal terminal of the terminal module.

As disclosed herein, the coaxial cable carrier is stamped and formed of sheet metal material and includes an elongated base having upstanding side arms forming a cradle for receiving the coaxial cable. The base has at least one aperture for soldering the conductive shield of the cable to the carrier through the aperture. The conductive shielding shell also is stamped and formed of sheet metal material.

Preferably, the signal terminal of the terminal module is insert molded in the insulator of the module to provide precise positioning of the signal terminal. The signal terminal has a forward contact end and a flexible terminating end against which the conductor of the cable is biased by the cover. In the preferred embodiment, the cover is pivotally mounted on the shielding shell.

Other features of the invention include complementary interengaging latch means between the shell and the cover to hold the cover in a closed position and complementary strain relief means between the carrier and the cover for clamping the coaxial cable between the carrier and the cover.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
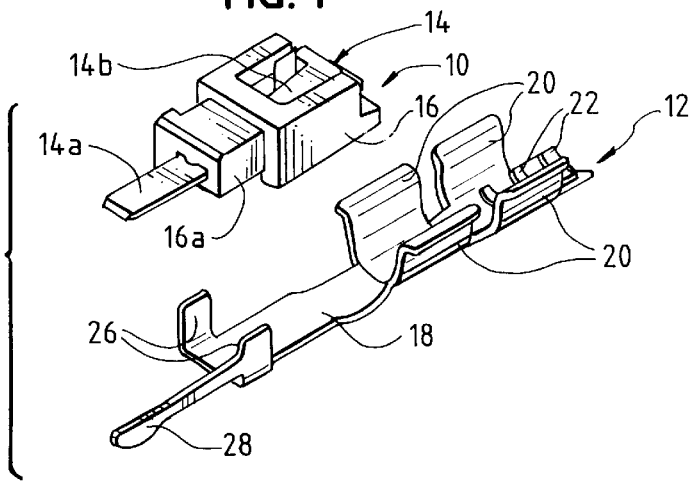
FIG. 1 is a perspective view of the terminal module and the coaxial cable carrier in unassembled condition.

Referring to the drawings in greater detail, and first to FIG. 1, the electrical connector of the invention includes a terminal module, generally designated 10, which is mountable on a coaxial cable carrier, generally designated 12. Terminal module 10 includes a signal terminal, generally designated 14, insert molded within an insulator block 16 which is a one-piece structure molded of dielectric material such as plastic or the like. The signal terminal has a forwardly projecting contact end 14*a* and a rear flexible terminating end 14*b*. The forward contract end of the terminal projects from a front nose 16*a* of insulator block 16.

Figure 3:
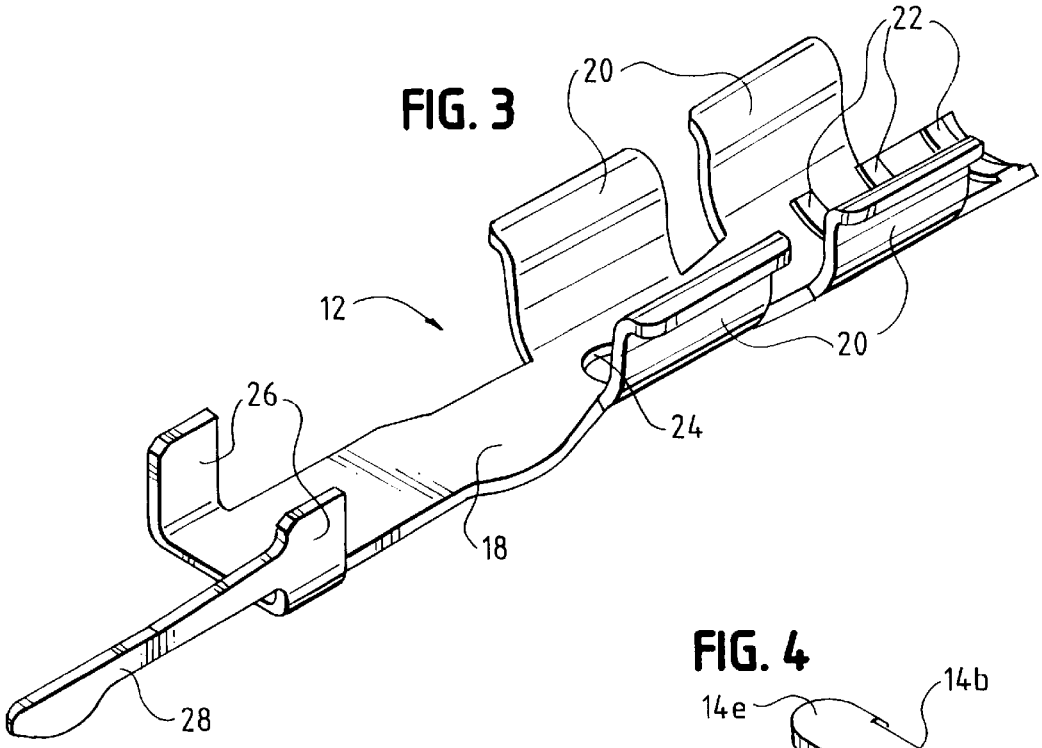
FIG. 3 is a perspective view of the coaxial cable carrier, alone.

Referring to FIG. 3 in conjunction with FIG. 1, coaxial cable carrier 12 is stamped and formed of conductive sheet metal material and includes an elongated base 18 having two pairs of upstanding side arms 20 forming a cradle for receiving a coaxial cable, as described hereinafter. A plurality of strain relief ribs 22 are formed at the rear end of the carrier. A hole 24 is formed in base 18 for soldering the carrier to the shielding braid of the cable through the hole.

A pair of front upstanding arms 26 receive front nose 16*a* of insulator block 16 of terminal module 10. One arm 26 fits into a slot in the front nose 16A and the other arm 26 contacts a side of the front nose opposite the slot. Finally, a ground terminal 28 projects forwardly of the carrier.

Figure 4:
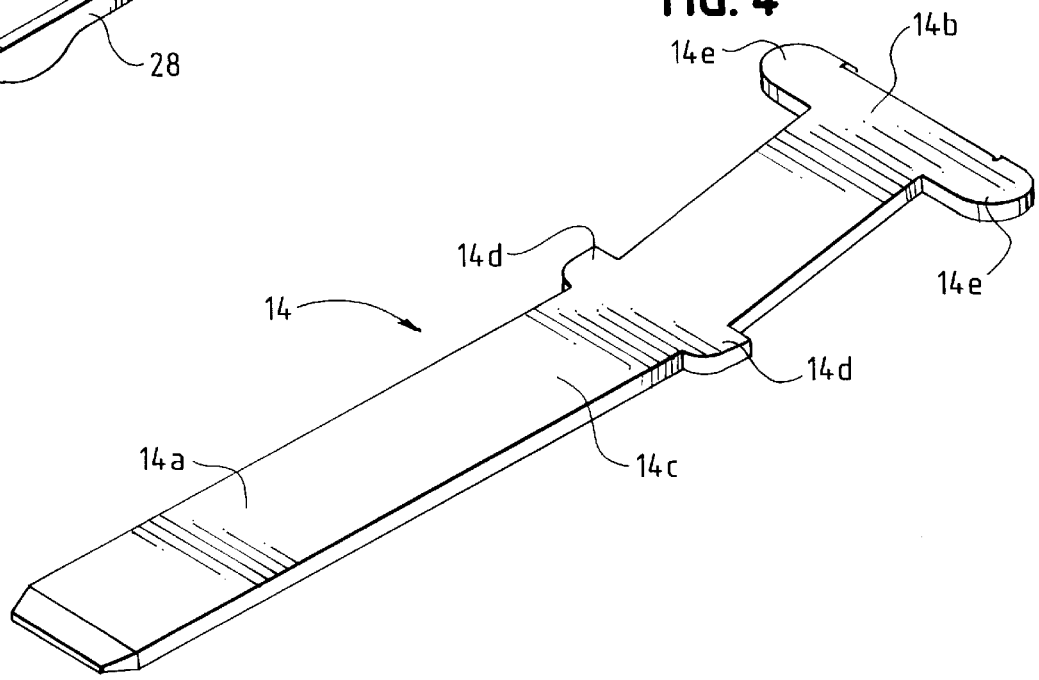
FIG. 4 is a perspective view of the signal terminal of the terminal module.

Referring to FIG. 4 in conjunction with FIG. 1, as stated above, signal terminal 14 includes forward contact end 14*a* and rear flexible terminating end 14*b*. The terminal is stamped and formed of conductive sheet metal material. A mid-section 14*c* of the terminal has a pair of outwardly projecting wings 14*d*. The mid-section and the wings are insert molded within insulator block 16, and the wings facilitate rigidly holding the terminal in the insulator block. A pair of outwardly projecting locking tabs 14*e* are formed at the rear of the terminal.

Figure 2:
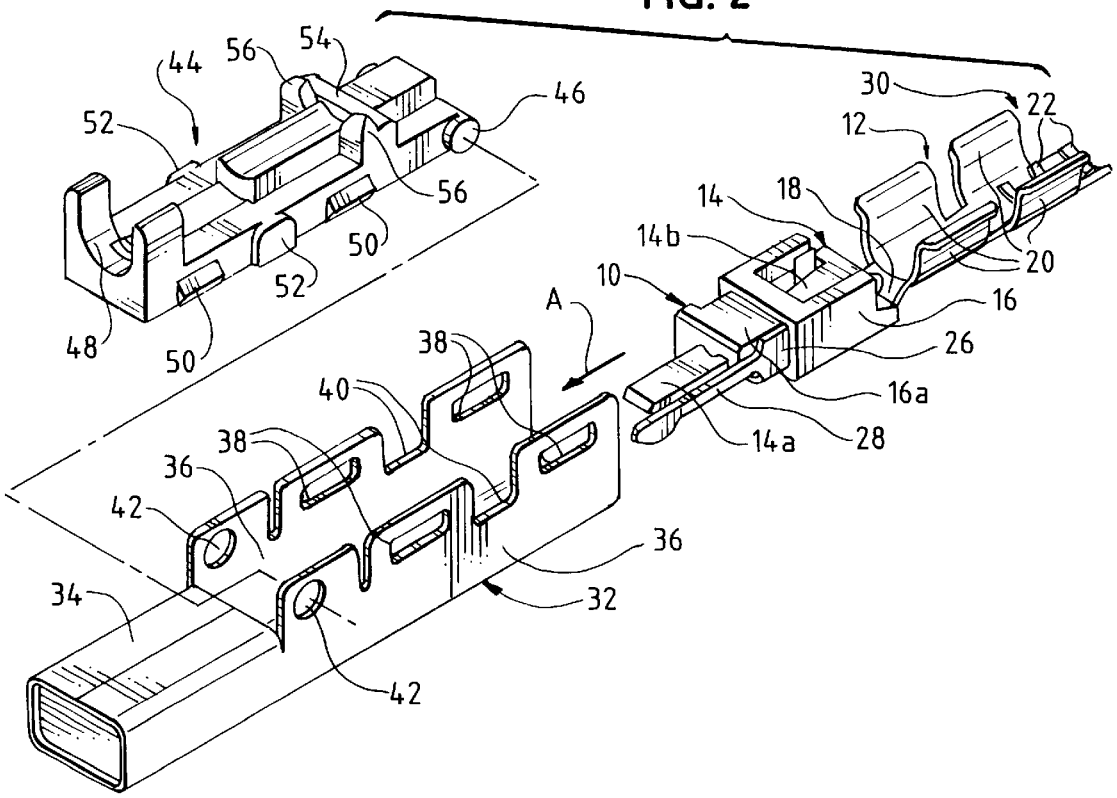
FIG. 2 is a perspective view of the terminal module and coaxial cable carrier in assembled condition, in conjunction with the shielding shell and the cover of the connector.

FIG. 2 shows a subassembly, generally designated 30, which is comprised of terminal module 10 and coaxial cable carrier 12. It can be seen that front nose 16*a* of the insulator block of the terminal module is press fit between front upstanding arms 26 of the carrier, and insulator block 16 of the module sits on top of base 18 of the carrier. Ground terminal 28 of the carrier extends along-side of and generally parallel to forwardly projecting contact end 14*a* of signal terminal 14.

Figure 5:
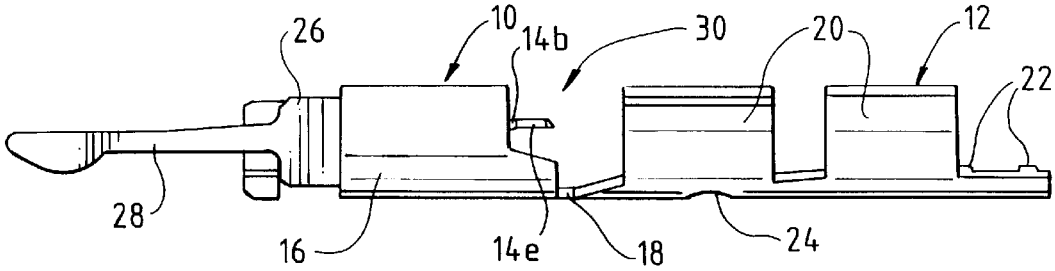
FIG. 5 is a side elevational view of the terminal module and the coaxial cable carrier in assembled condition.

Still referring to FIG. 2, subassembly 30 comprising terminal module 10 and coaxial cable carrier 12 is assembled to a shielding shell, generally designated 32, by inserting the subassembly into the shell in the direction of arrow "A". A side elevational view of subassembly 30 also is shown in FIG. 5.

Shielding shell 32 is a one-piece structure stamped and formed of conductive sheet metal material. The shell has a closed front end 34 within which contact end 14*a* of signal terminal 14 and ground terminal 28 of carrier 12 are disposed, with the terminals being completely surrounded by the closed front end of the shell. The rear end of shell 32 is generally U-shaped and includes a pair of spaced, upstanding side walls 36. Each side wall has a pair of latch apertures 38 and an interlocking notch 40. Each side wall also has a pivot hole 42 near the front top corner of the side wall.

Still referring to FIG. 2, a cover, generally designated 44, is unitarily molded of dielectric material such as plastic or the like. The cover has a pair of pivot trunions 46 on opposite sides thereof that snap into pivot holes 42 of shell 32 to pivotally mount the cover to the shell. A U-shaped strain relief flange 48 is formed at the opposite end of the cover and will become aligned with strain relief ribs 22 of coaxial cable carrier 12 to clamp the cable therebetween. The cover has a pair of chamfered latch bosses 50 on each opposite side thereof for snapping into locking engagement within latch apertures 38 in side walls 36 of the shell. The cover has an interlocking boss 52 on each opposite side thereof for positioning into interlocking notches 40 in side walls 36 of the shell. When the cover is pivoted to its closed position as described hereinafter, a cross flange 54 of the cover engages and biases the conductive core of the coaxial cable against flexible terminating end 14*b* of signal terminal 14. This moves the flexible terminating end 14*b* to a location parallel to the ground terminal ensuring a consistent impedance through that portion of the terminal. A pair of locking prongs 56 are formed at opposite ends of cross flange 54 of the cover for locking behind locking tabs 14*e* (FIG. 4) of the signal terminal.

Figure 6:
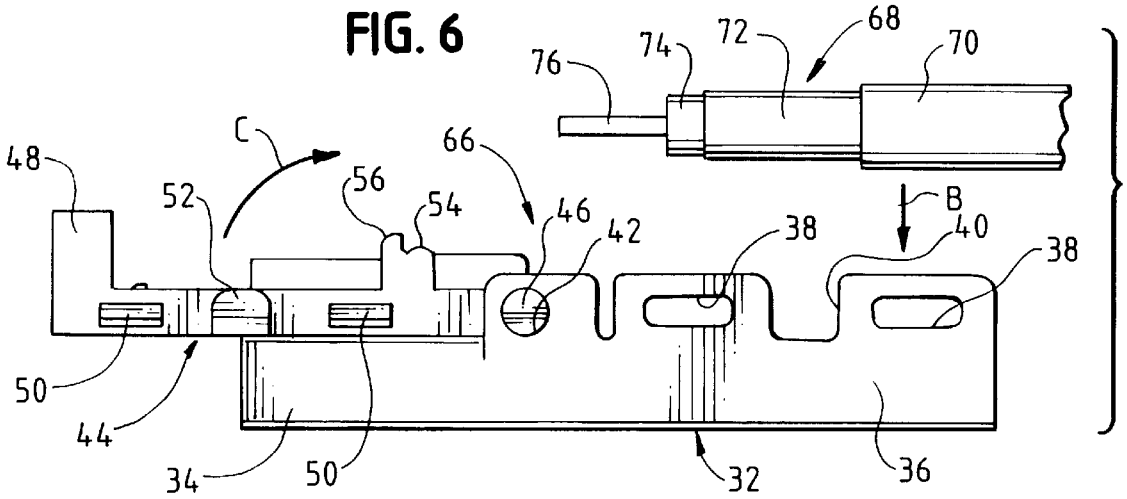
FIG. 6 is a side elevational view of the assembled connector with the cover in the open position, in conjunction with a prepared coaxial cable.
Figure 7:
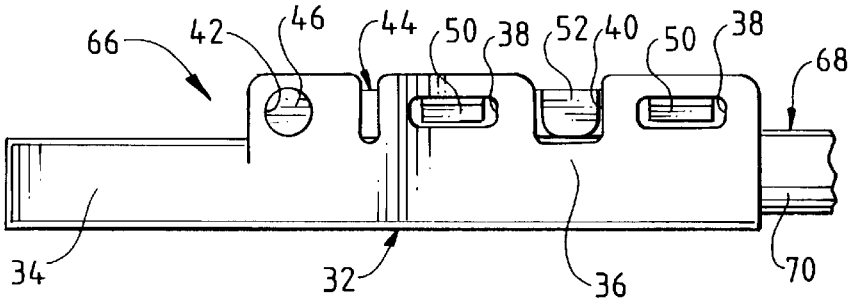
FIG. 7 is a side elevational view of the connector with the cover closed.

FIG. 7 shows the completely assembled electrical connector, generally designated 66, of the invention with cover 44 pivotally mounted to shell 32 and with the cover in its open position. FIG. 6 also shows a coaxial cable, generally designated 68, in a prepared condition. Specifically, the cable includes an outer dielectric tubular cover 70 about a conductive shield in the form of a metal braid 72. The braid surrounds an inner dielectric sheath 74 which, in turn, surrounds a center conductive core or conductor 76 of the cable. It can be seen that outer cover 70 has been cut back to expose shielding braid 72. The braid and inner dielectric 74 have been cut back to expose conductor 76. The cable is assembled to connector 66 in the direction of arrow "B", with cover 44 in open condition. When the cable is assembled to the connector, outer dielectric cover 70 is aligned with strain relief ribs 22 (FIG. 3) of carrier 12. Shielding braid 72 is aligned with solder hole 24 of the carrier. Conductor 76 of the cable is aligned with flexible terminating end 14*b* of signal terminal 14.

Figure 8:
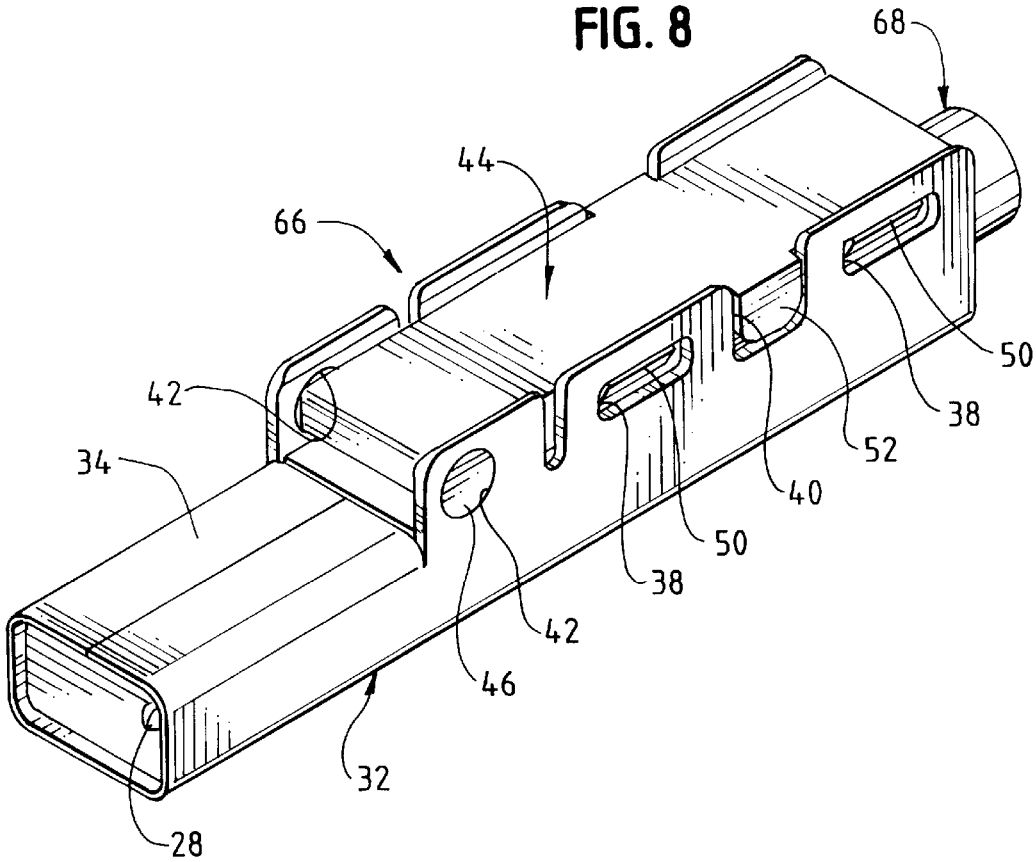
FIG. 8 is a top perspective view of the completely assembled and terminated connector.
Figure 9:
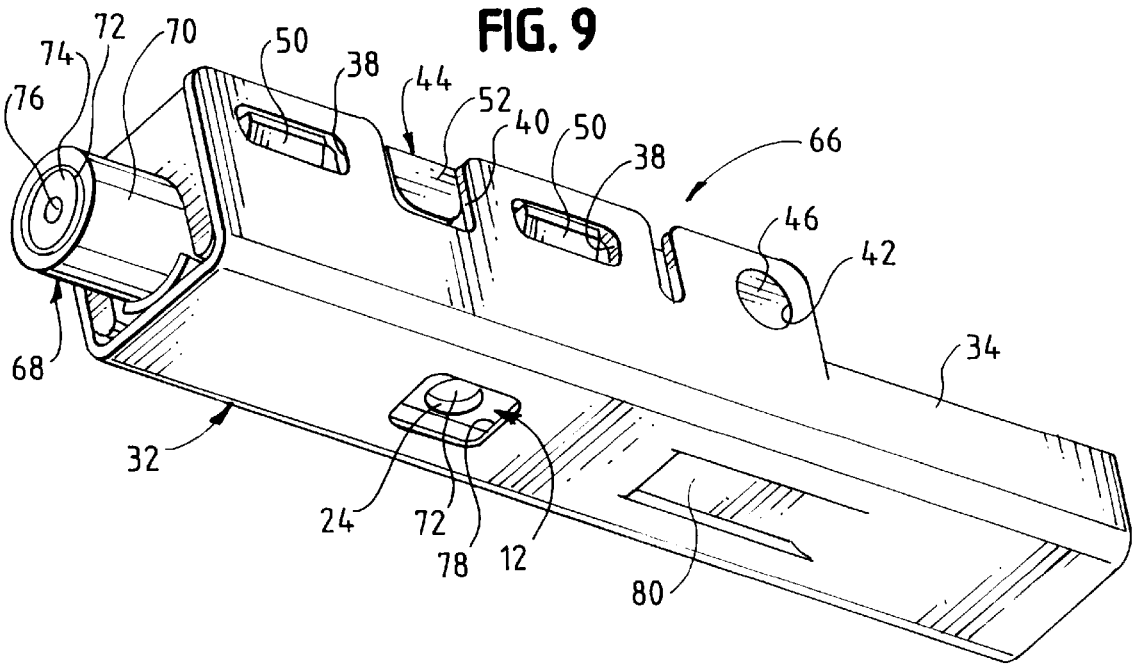
FIG. 9 is a bottom perspective view of the completely assembled and terminated connector.

In order to completely terminate coaxial cable 68 to connector 66, cover 44 is pivoted in the direction of arrow "C" (FIG. 6) to its closed and latched condition shown in FIGS. 7–9. In the closed position of the cover, chamfered latch bosses 50 of the cover snap into locking engagement within latch apertures 38 of shell 32, while interlocking bosses 52 move into interlocking notches 40 of the shell. As stated above, when the cover is closed, strain relief flange 48 of the cover clamps the outer dielectric cover of the cable against strain relief ribs 22 (FIG. 3) of carrier 12, and cross flange 54 of the cover biases the conductor of the cable against flexible terminating end 14*b* of signal terminal 14.

Referring to FIG. 9, it can be seen that the bottom of shell 32 has a solder hole 78 aligned with solder hole 24 in carrier 12 to solder the shielding braid 72 of the cable to the conductive carrier which is in engagement with conductive shell 32. FIG. 9 also shows that the bottom of the stamped and formed shell 32 is provided with a shear form 80 to ensure correct impedance by supporting the coaxial cable carrier 12 a predetermined distance from the signal terminal 14 and to enhance engagement of the conductive shell with the conductive coaxial cable carrier 12.

When cover 44 is closed onto shell 32 to completely terminate coaxial cable 68 to connector 66, ground terminal 28 of carrier 12 and forward contact end 14*a* of signal terminal 14 extend generally parallel within and are surrounded by closed front end 34 of the shell. With the shielding braid 72 electrically coupled to conductive carrier 12 which, in turn, is in engagement with conductive shielding shell 32, the connector provides a stable ground potential with a consistent impedance through the connector and avoids electromagnetic interference at the terminated interface of the cable.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. An electrical connector for terminating a coaxial cable having at least an inner conductor and an outer conductive shield, comprising:

a coaxial cable carrier for holding the coaxial cable and including a forwardly projecting ground terminal, a conductive carrier being in engagement with the conductive shield of the cable;

a terminal module including an insulator mounting a forwardly projecting signal terminal, the module being mountable on said carrier to form a subassembly with the signal terminal generally parallel to the ground terminal;

a conductive shielding shell for receiving said subassembly with the conductive shell being in engagement with the coaxial cable carrier; and a cover mounted on the shell for holding the conductor of the cable in engagement with the signal terminal of the terminal module.

2. The electrical connector of claim 1 wherein the signal terminal of said terminal module is insert molded in the insulator of the module.

3. The electrical connector of claim 1 wherein said signal terminal has a forward contact end and a flexible terminating end against which the conductor of the cable is biased by said cover to position the terminating end parallel to the ground terminal.

4. The electrical connector of claim 1 wherein said shell is stamped and formed of sheet metal material.

5. The electrical connector of claim 1, including complementary interengaging latch means between the shell and the cover to hold the cover in a closed position.

6. The electrical connector of claim 1, including complementary strain relief means between the carrier and the cover for clamping the coaxial cable therebetween.

7. The electrical connector of claim 1 wherein said cover is pivotally mounted on the shell.

8. The electrical connector of claim 1 wherein said coaxial cable carrier is stamped and formed of sheet metal material.

9. The electrical connector of claim 8 wherein said coaxial cable carrier includes an elongated base having upstanding side arms forming a cradle for receiving the coaxial cable.

10. The electrical connector of claim 9 wherein said base has at least one aperture for soldering the conductive shield of the cable to the carrier through the aperture.

11. An electrical connector for terminating a coaxial cable having at least an inner conductor and an outer conductive shield, comprising:

a coaxial cable carrier for holding the coaxial cable and including a forwardly projecting ground terminal, a conductive carrier being stamped and formed of sheet metal material and being in engagement with the conductive shield of the cable;

a terminal module including a molded insulator insert molded about at least a portion of a forwardly projecting signal terminal, the module being mountable on said carrier to form a subassembly with the signal terminal generally parallel to the ground terminal;

a conductive shielding shell for receiving said subassembly, the shell being stamped and formed of sheet metal material and being in engagement with the conductive carrier; and a dielectric cover pivotally mounted on the shell for movement between and open position allowing assembly of the coaxial cable in the connector and a closed position for holding the conductor of the cable in engagement with the signal terminal of the terminal module.

12. The electrical connector of claim 11 wherein said signal terminal has a forward contact end and a flexible terminating end against which the conductor of the cable is biased by said cover to position the terminating end parallel to the ground terminal.

13. The electrical connector of claim 11, including complementary interengaging latch means between the shell and the cover to hold the cover in a closed position.

14. The electrical connector of claim 11, including complementary strain relief means between the carrier and the cover for clamping the coaxial cable therebetween.

15. The electrical connector of claim 11 wherein said coaxial cable carrier includes an elongated base having upstanding side arms forming a cradle for receiving the coaxial cable.

16. The electrical connector of claim 15 wherein said base has at least one aperture for soldering the conductive shield of the cable to the carrier through the aperture.

17. An electrical connector for terminating a coaxial cable having at least an inner conductor and an outer conductive shield, comprising:

a coaxial cable carrier for receiving the coaxial cable with the carrier in engagement with the conductive shield of the cable, the carrier including a ground terminal;

a terminal module including an insulator mounting a signal terminal, the module being mountable on said carrier;

a conductive shielding member for receiving the coaxial carrier and terminal module with the conductive shielding member being in engagement with the coaxial cable carrier; and a cover mounted on the shielding member for holding the conductor of the cable in engagement with the signal terminal of the terminal module.

18. The electrical connector of claim 17 wherein a conductive carrier and said conductive shielding member each is stamped and formed of sheet metal material.

19. The electrical connector of claim 17 wherein the signal terminal of said terminal module is insert molded in the insulator of the module.

20. The electrical connector of claim 17 wherein said signal terminal has a forward contact end and a flexible terminating end against which the conductor of the cable is biased by said cover to position the terminating end parallel to the ground terminal.

21. The electrical connector of claim 17, including complementary strain relief means between the carrier and the cover for clamping the coaxial cable therebetween.

22. The electrical connector of claim 17 wherein said cover is pivotally mounted on the shell.

23. The electrical connector of claim 17, including complementary interengaging latch means between the shielding member and the cover to hold the cover in a closed position.

24. An electrical connector for terminating a coaxial cable having at least an inner conductor and an outer conductive shield, comprising:

a subassembly including a signal terminal and a ground terminal;

a conductive shielding shell for receiving said subassembly with the conductive shell being in conductivity with the ground terminal; and a dielectric cover pivotally mounted on the shell for movement between an open position allowing assembly of the coaxial cable and a closed position for holding the conductor of the cable in engagement with the signal terminal.

25. The electrical connector of claim 24 wherein said subassembly includes conductive means coupled to the ground terminal and in engagement with the conductive shell, said cover including means for biasing the conductive shield of the cable in engagement with said conductive means.

* * * * *